United States Patent [19]

Kelly

[11] 4,040,629

[45] Aug. 9, 1977

[54] COMMODITIES BOARD GAME APPARATUS

[76] Inventor: John Kelly, 1020 Glen Flora Ave., Waukegan, Ill. 60085

[21] Appl. No.: 589,019

[22] Filed: June 23, 1975

[51] Int. Cl.[2] ..... A63F 3/00

[52] U.S. Cl. ..... 273/135 C

[58] Field of Search ..... 273/135 R, 135 AC, 135 A, 273/135 C, 134 AF, 134 B, 134 C, 134 E, 134 A; 35/24 R, 24 A

[56] References Cited

U.S. PATENT DOCUMENTS

| | | | |
|---|---|---|---|
| 1,161,984 | 11/1915 | Scott | 273/135 C |
| 2,174,058 | 9/1939 | McGennis | 273/134 AF |
| 2,210,201 | 8/1940 | Draper et al. | 273/135 C |
| 2,693,961 | 11/1954 | Ripley, Jr. | 273/134 C |
| 3,050,303 | 8/1962 | Borci | 273/135 C |
| 3,176,430 | 4/1965 | Ryan | 273/134 C |
| 3,228,694 | 1/1966 | Johnson | 273/134 C |
| 3,499,646 | 3/1970 | Burgess, Jr. et al. | 273/135 C |
| 3,539,189 | 11/1970 | Shelton | 273/134 AF |
| 3,734,508 | 5/1973 | Snyder | 273/134 C |

*Primary Examiner*—Anton O. Oechsle
*Assistant Examiner*—Harry G. Strappello
*Attorney, Agent, or Firm*—Leydig, Voit, Osann, Mayer & Holt, Ltd.

[57] ABSTRACT

A game apparatus adapted to acquaint players with the procedures and risks in trading in the commodities market. The apparatus includes a game board that delineates a plurality of commodities and the conditions under which they are traded, a spinner on the deck board for establishing the beginning prices of each of the commodities, a deck of price fluctuation cards for randomly establishing daily changes in the price of each commodity, dial indicators associated with the board for showing the current price of each commodity as it fluctuates, and transaction slips for recording each player's trading transactions.

3 Claims, 7 Drawing Figures

COMMODITIES BOARD GAME APPARATUS

DESCRIPTION OF THE INVENTION

The present invention relates generally to games, and more particularly to a board game involving the trading of commodities.

While millions of people invest in and own common stock in American companies, relatively few participate in or even have knowledge of the operation of the commodities market. Several reasons account for the much lesser degree of participation in commodities. First, unlike the usual transaction in the stock market where the shares of stocks are paid for and owned outright by the purchaser for long periods, the most common type of commodity transaction is more complex in that the commodity is bought or sold at a future date with only a relatively small portion of the price being paid into a margin account to cover the transaction until the final settlement date. With such trading leverage, as it is referred to in the trade, even small changes in price can result in substantial profits or losses to the investor. Moreover, the prices of commodities often can be very volatile, with numerous factors, such as weather conditions, large government sales, and the like, frequently causing sudden and extreme price fluctuations. While the commodity markets have limits which prevent the daily change in price beyond a set amount, some conditions have the effect of causing the price to move the limit a number of days successively until it reaches a level conducive to further trading. Thus, even with such limits on trading, the risk of significant price change always is present.

It is an object of the present invention to provide a game apparatus that will give a simplified picture of the commodities market, but yet acquaint the player with its general mode of operation and the extreme risks involved.

Other objects and advantages of the invention will become apparent as the foregoing description proceeds, taken together with the accompanying drawings, wherein.

Figure 1:
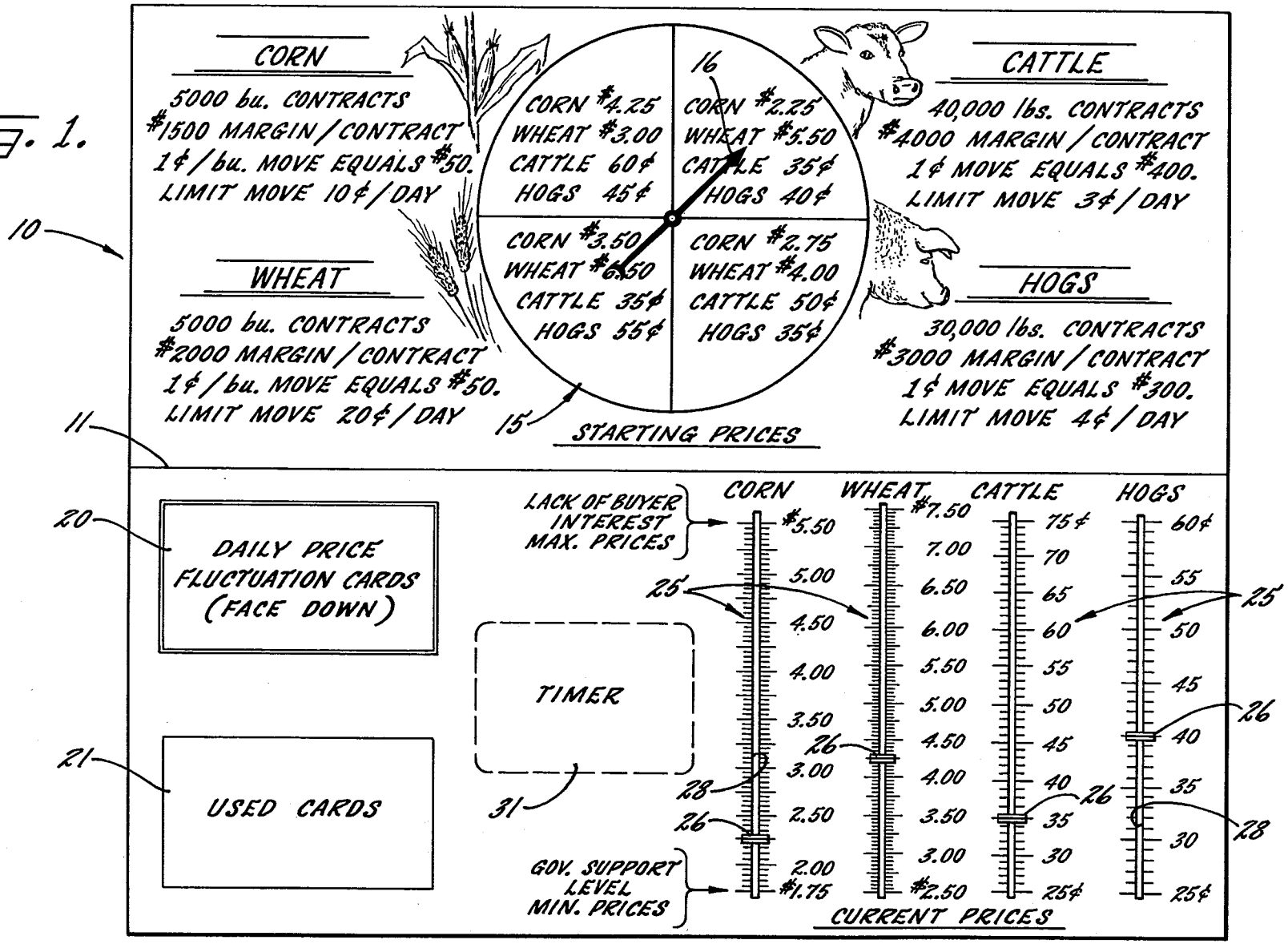
FIG. 1 is a plan view of a game board according to the present invention.

While the invention is susceptible of various modifications and alternative constructions, certain illustrative embodiments thereof have been shown in the drawings and will be described below in detail. It should be understood, however, that there is no intention to limit the invention to the specific forms disclosed but, on the contrary, the intention is to cover all modifications, alternative constructions, and equivalents falling within the spirit and scope of the invention.

Applicant chooses to call his game "HEDGE". HEDGE is a board game, preferably for two or more players, and is designed to provide each player with an opportunity to use his skill and chance in investing in the commodities market. Each player begins a game with a sum of play currency and can trade in any of several commodities as he desires throughout the duration of his game. At the end of a predetermined period of trading, the value of all contracts held by the player must be determined and added to his existing cash and the player with the greatest net worth is the winner.

Turning more particularly to FIG. 1 of the drawings, there is shown a game board 10 that preferably is foldable along a transverse line 11 when the game is not in use for convenient storage. The game board 10 has delineated thereon trading information with respect to a plurality of commodities involved in the game. The illustrated game board shows four commonly traded commodities, namely corn, wheat, hogs and cattle. The trading information provided for each commodity is set forth on the board so as to be a convenient reminder and guide to the players. For example, it is shown that corn is traded in 5,000 bushel lots or contracts, a $1,500 margin payment is required per contract, and a one percent bushel move in price represents a $50 change in the worth of the contract. The limit move per day is ten cents per bushel. Similarly, wheat is shown as being traded in 5,000 bushel contracts so that a one cent change in price also equals a $50 change in the worth of the contract. In this case, however, a $2,000 margin payment is required per contract, and the limit in price change is twenty cents per bushel per day. Hog trading is shown as being in increments of 30,000 pound contracts so that a one cent change per pound in price represents a $300 gain or loss to the trader, and the limit price change per day is four cents per pound. A margin payment of $3,000 per contract is required. Finally, cattle is specified as being traded in 40,000 pounds contracts so that a one cent change in price represents $400 to the trader. The margin payment for cattle is $4,000 and the limit price change per day is three cents per pound.

For establishing an opening day price at the beginning of each game, the board 10 also has delineated thereon a plurality of quadrants 15 which each form part of a circular area and contain a different set of prices for each of the four commodities. A pointer or spinner 16 is rotatably mounted on the board so that it may be spun to randomly indicate one of the quadrants. The prices of the four commodities in that quadrant are the starting prices at the beginning of the game. For example, in the illustrated board 10, the spinner has been spun to indicate starting prices of $2.25/bu. for corn, $5.50/bu. for wheat, $.35/lb. for cattle, and $.40/lb. for hogs.

Figure 2:
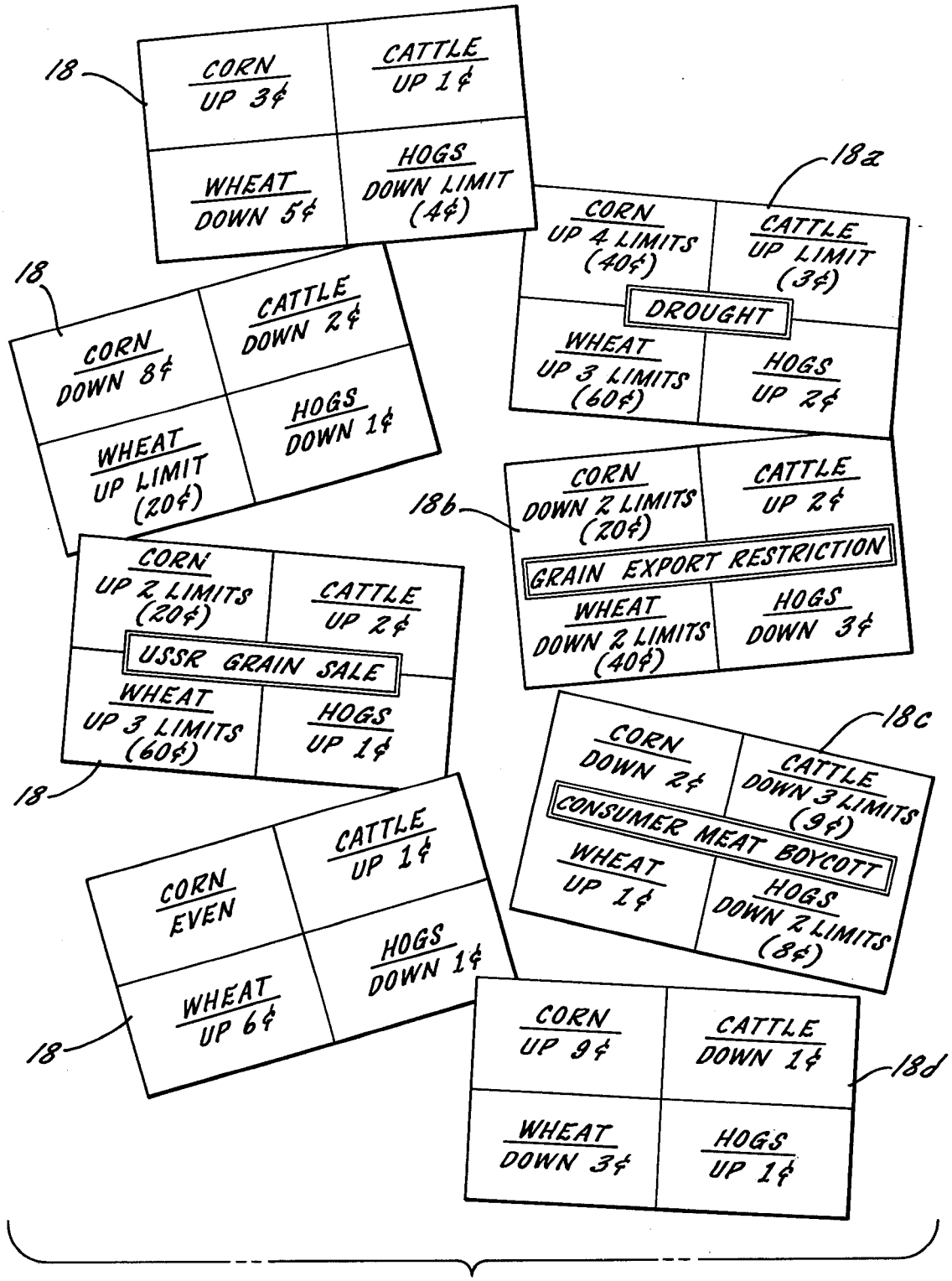
FIG. 2 is a bracketed view of a representative set of cards for use with the game board to establish fluctuations in market prices.
Figure 3:
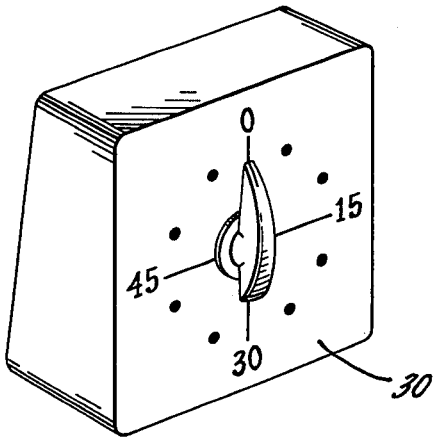
FIG. 3 is a perspective view of a timer used to control the duration of the game.

In order to randomly establish daily changes in the price of each commodity during play of the game, a deck of price fluctuation cards 18 are provided, representative ones of which are shown in FIG. 2. Each of the cards 18 indicate the daily change in the market price for each of the four commodities involved in the game. In the most common case, the increase or decrease in price is less than the permissible limit for the respective commodity. In some instances, however, the cards indicate that a particular commodity was "up limit" or "down limit," thus indicating the maximum change permitted in a day. To remind the player of this limit, the numerical value of the limit change also is indicated below.

In addition, a relatively small number of the cards indicate events which have more catastrophic effects on one or more of the commodities. For example, card 18*a* indicates a "DROUGHT" which has the effect of reducing future crops, and thus, increasing their price. The card 18*a*, therefore, indicates that corn was up 4 limits or forty cents and wheat was up 3 limits or sixty cents. While in actual trading such a drought may have the effect of raising the trading price the limit over 4 days in a row without significant trading taking place, to simplify the game, the card 18*a* specifies the entire increase at the same time. Similarly, events are indicated on other cards which have serious effects on various of the commodity prices. The card 18*b* shows the imposition of "Grain Export Restrictions," which has the effect of reducing demand, and thus lowering the price. In this case, the price of wheat is down by 2 limits or 40 cents, and corn is down 2 limits or 20 cents. The card 18*c* shows a "Consumer Meat Boycott," lowering the price of cattle by 9 cents per pound, and hogs by 8 cents per pound. It will be understood that the cards 18 may be successively drawn to establish the random fluctuation in the prices of the several commodities with each card representing a new trading day. To facilitate the use of the cards 18, the game board 10 has an area 20 designated for placement face down of the deck of cards and an area 21 for placement of the cards after use.

To indicate the current daily trading price of each commodity as it fluctuates in accordance with the changes established by the price fluctuation cards 18, the board 10 further is provided with price scales 25 for each commodity and a dial 26 that is slidable along a guideway 28 in the board adjacent each scale. The price scales 25 in this case each extend between minimum and maximum prices at which the commodity can be traded in the game. The lower end of each price scale is shown to be limited by a "Government Support Level" which establishes the minimum price, while the maximum price at the upper end of the scale is limited by "Lack of Buyer Interest." Thus, it will be seen that the current price dials 26 for the commodities may be easily adjusted to reflect the new prices after each card is turned over.

For recording the trading of commodity contracts during play of the game, pre-printed transaction record slips 29 may be used. The illustrated slips 29 each are printed with an S and B, a list of the four commodities, and spaces for the purchase price and the number of contracts traded. To record the transaction, it is merely necessary to circle the commodity involved, circle the S or B depending upon whether a contract has been sold or purchased, and fill in the number of contracts and the current price at the time of the transaction. For example, slip 29*a* shows the record of a transaction for the purchase of two contracts of corn at $3.65 per bushel.

Figure 5:
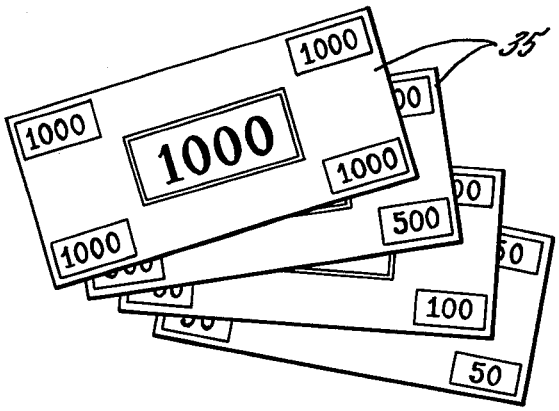
FIG. 5 shows a quantity of money employed in playing the game.
Figure 4:
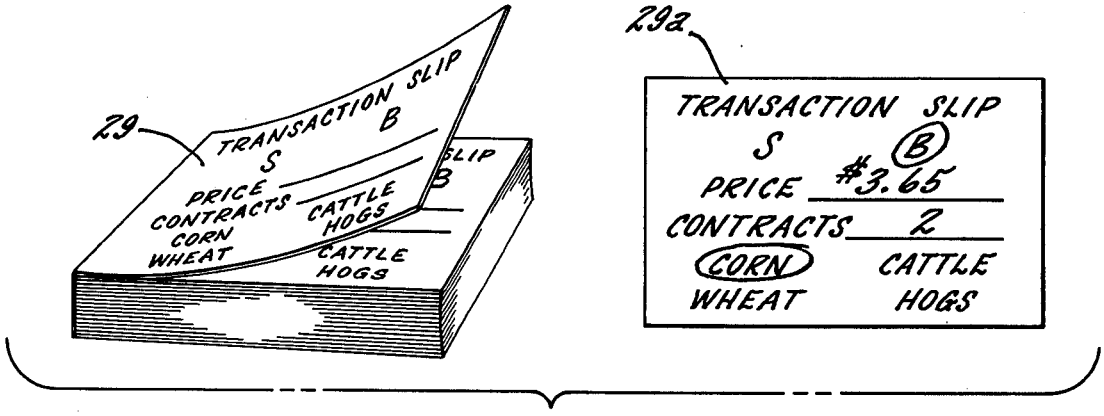
FIG. 4 is a bracketed view of a pad of transaction recording slips utilized in the game with one of the slips completed and removed.

To regulate or limit the amount of trading permitted in each game, in the illustrated embodiment a timer 30 is provided. The timer 30 may be of a known spring operated type which can be set for a selected number of minutes, preferably up to at least 60 minutes, at the end of which time an alarm is sounded. Because the timer is running during the game, the players often will find it necessary to act quickly in completing their transactions, as is also frequently the case in actual trading. In practice, it has been found that a game of 30 to 60 minutes in duration generally provides time for the players to develop sufficient trading techniques and strategies for full enjoyment of the game. The board in the present instance includes an area 31 where the timer 30 may be set for convenient observation by all of the players. Alternatively, it will be understood that trading could be limited by other means, such as by the number of daily price fluctuation cards used. For example, a deck of 40 to 50 price fluctuation cards 18 could be shuffled at the beginning of the game, with the game continuing until the deck was depleted In playing the game, the various players could be positioned about the game board 10 so that they are in position to see the current price scales 25. Preferably, one of the players serves solely as the broker and banker for each game. The banker distributes to the other players a determined amount, such as $25,000, of play currency 35 of the type shown in FIG. 5. The banker or broker also should assume responsibility for controlling the play and speed of the game, as will become apparent.

The broker or any one of the players may then spin the spinner 16 to determine the beginning prices for each of the four commodities. The broker then moves the respective dials 26 on the current price scales 25 to those prices. At that point, the players have the option to buy or sell any of the four commodities at the current price. For each contract of a commodity that is purchased or sold the margin amount specified on the game board for that commodity must be paid to the broker, and the broker will record the transaction on one of the transaction record slips 29 which is given to the player.

After the broker has provided each player with the opportunity to trade at that day's current prices, a price fluctuation card 18 is turned over from the deck which previously has been shuffled and placed face down on the board in the designated area 20. The broker will then move the dials 26 up or down in accordance with the directives of the upturned price fluctuation card to record the new current prices of the commodities. For example, if the opening day price of wheat was $4.25 and the card 18*d* were drawn which specifies a drop in the wheat price of three cents per bushel, the dial 26 adjacent the wheat price scale 25 would be lowered 3 cents to indicate the new price for that day. Once the broker has adjusted the dials 26 to reflect the new prices for each of the commodities, the players again successively have the option to buy or sell contracts at the new price.

In addition, if a player had purchased a contract of wheat at $4.25 the previous day and the price went up three cents he would have the option of selling that contract at the higher price to realize his profit. Such a transaction is effected by turning in the slip 18 evidencing the earlier purchase. The broker would then calculate the profit as follows. Since a one cent move represents a $50 change in the contract value and the wheat was then three cents per bushel higher than the player had previously agreed to pay for it, the contract had increased in value by $150 (3 × $50). This amount would be paid to the player by the broker, together with the return of his $2,000 margin payment. If he had purchased two contracts of wheat at the earlier lower price, his profit would be twice that amount, or $300, and he also would be returned the $4,000 margin payment previously required for the two contracts. Similarly, if the price of wheat had gone down three cents to $4.22 after a contract had been purchased by a player at $4.25 the contract would have decreased in value by $150 (3 × $50). If the player decided it was in his best interest to take his loss, by turning in the transaction slip the broker would return the player's margin payment after subtracting the $150 loss.

Each of the players alternatively has the option of selling contracts for the various commodities. Thus, if a player sold a contract of wheat at $4.25 on the opening day and the price subsequently dropped to $4.22 he could in effect cover his earlier sale at the lower price and realize a profit of $150 (3 × $50). In other words, if he bought wheat to cover that which he had previously sold it would cost him $150 less than the proceeds from the earlier sale. The contract has thereby increased in value by $150 during the time it was held by the player. Again, the mechanics involved would be the return of the transaction slip 18 evidencing the earlier sale and the collection of the $150 profit from the broker, which represents the increased value of the contract, plus the return of the $2,000 margin deposit. Likewise, if the player had sold wheat at $4.25 and the price subsequently increased three cents per bushel, the value of the contract would have decreased $150 (3 × $50) since it would cost more to buy wheat to cover the previous sale than the player was entitled to receive from the sale.

After each round of trading at the current market price, another price fluctuation card 18 is drawn from the deck to determine the change in commodity prices for the next day of trading, which the broker immediately causes the price scale dials 26 to reflect. Trading may then again begin at the new market prices. It will be seen that a certain amount of skill can be developed by each player in determining the strategy as to whether to buy or sell. For example, if the price of a commodity starts out high or rises to a relatively high point the player would realize that the likelihood of a price drop increases, so that he may decide to sell additional contracts, or cash in some previous purchases. On the other hand, as the price drops to a relatively low level it may be wise to buy. Furthermore, as previously discussed, some of the cards set forth events which have more catastrophic effects on the market. If the card **18*a*** is drawn indicating DROUGHT the significant increase in the price of corn and wheat could materially affect the worth of the players' holdings. Thus, the player will soon gain an appreciation for the fact that by reason of the leverage or hedging permitted in the purchase and sale of the commodities and the volatileness of the prices, considerable discretion must be exercised in trading.

The winner of the game is determined when the timer 30 sounds the termination of the designated period of trading. At that time, each player must determine his net worth as established by the total of (1) his cash on hand, and (2) the value of the contracts in his possession at the final market prices as indicated at that time by the dials 26. The value of each contract held by the player may be determined in the manner previously described. For example, if a player had $8,000 cash in his hand and possessed the trading slips set forth below, his net worth would be calculated as follows if the closing prices were as indicated below:

| | | | |
|---|---|---|---|
| (1) | Closing Prices: | Corn | $3.75 |
| | | Wheat | 5.25 |
| | | Cattle | .40 |
| | | Hogs | .45 |
| (2) | Value of Contracts | | |

-continued

| | | | |
|---|---|---|---|
| (a) | 2 contracts Corn bought at $3.50 | | |
| | 2 × (3.75 − 3.50) × 50 = | $2,500 | Profit |
| | | 3,000 | Margin deposit |
| | Value | $5,500 | |
| (b) | 1 contract Corn sold at $3.65 | | |
| | (3.75 − 3.65) × 50 = | (−$500) | Loss |
| | | 1,500 | Margin deposit |
| | Value | $1,000 | |
| (c) | 3 contracts Wheat sold at $6.00 | | |
| | 3 × (6.00 − 5.25) × 50 = | $11,250 | Profit |
| | | 4,000 | Margin deposit |
| | Value | $15,250 | |
| (d) | 2 contracts Cattle bought at $.55½ | | |
| | 2 × (.52 − .40) × 400 = | (−$9,600) | Loss |
| | | 6,000 | Margin deposit |
| | Value | ($3,600) | |
| (e) | 1 contract Hogs sold at $.44½ | | |
| | (.45 − .44) × 300 = | $300 | Profit |
| | | 2,000 | Margin deposit |
| | Value | $2,300 | |
| | Total Value of Contracts: | +5,500 | |
| | | +1,000 | |
| | | +15,250 | |
| | | −3,600 | |
| | | +2,300 | |
| | | 20,450 | |
| (3) | Net Worth of Player | | |
| | Value of Contracts | $19,900 | |
| | Cash on Hand | 8,000 | |
| | Net Worth | $27,900 | |

The player with the greatest net worth at the end of the game is declared the winner.

Figure 6:
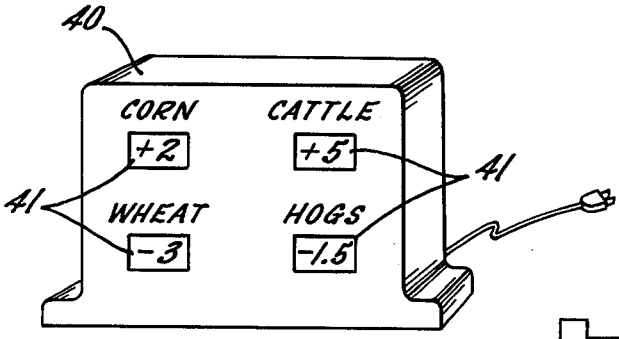
FIG. 6 shows a perspective of an alternative means for establishing fluctuations in the market prices of the commodities.
Figure 7:
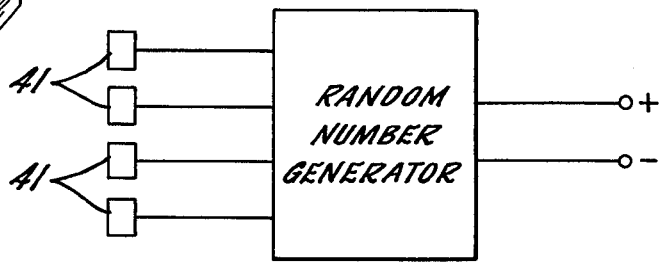
FIG. 7 is a diagrammatic illustration of the electronic control for the device shown in FIG. 6.

While the foregoing has described the use of a deck of price fluctuation cards for establishing the daily changes in the commodity prices, alternatively electronic means could be employed for establishing such price changes. For example, FIG. 6 shows a device 40 having a numerical readout meter 41 for each of the four commodities. The device 40, as diagrammatically illustrated in FIG. 7, includes a random number generator that can be connected to an electrical power source. The readout meters 41 each are coupled to the generator. Such generators, as are well known in the art, are adapted to randomly generate numbers each time they are energized, and in the illustrated embodiment, a random plus or minus sign also is generated with each number. Accordingly, each time the device 40 is activated the meters 41 will indicate an increase (plus) or decrease (minus) in the price in each of the commodities. The price fluctuation dials 26 can be adjusted to reflect these price changes in the manner previously described.

From the foregoing, it can be seen that applicant has provided a game apparatus that provides a simplified picture of the commodities market, but yet acquaints the players with its general mode of operation and the extreme risks that can be involved. While the game has been described as being playable by two or more players, it will be understood that the game also may be played by a single player with the object in that case being to achieve the maximum net worth during the trading period.

I claim as my invention:

1. A playing apparatus comprising a playing board delineating a plurality of commodities and the trading terms at which each commodity may be traded by any player during a given playing period, means for randomly establishing, at the beginning of the game, prices for each of the commodities at which all players may trade the commodities during the first playing period, a plurality of cards for randomly establishing, at the beginning of each successive playing period, respective incremental price changes for each of the commodities, to give a new set of prices at which all players may trade the commodities during respective successive playing periods, each of said cards having indicia thereon indicating an amount of change in the respective price of each commodity, an individual scale on said board for each commodity, said scales having divisions to represent incremental price differences between a minimum and maximum values for each commodity, an individual pointer slideably disposed in said board adjacent each respective scale for individually indicating the current price of each commodity, means for recording each players purchases and scales of said commodities at the prices in effect during the playing period when the respective purchases and sales were transacted, and means for regulating the amount of trading during said playing after which the net gain or loss from each players trading is determined.

2. The game apparatus of claim 1 in which said beginning price establishing means includes indicia on said board indicating a plurality of sets of different prices for each of said commodities, and a spinner rotatably mounted on said board for randomly indicating one of said sets of prices.

3. The game apparatus of claim 1 in which said regulating means is a timer that may be selectively set to a desired length of time.

* * * * *